United States Patent [19]

Walters

[11] Patent Number: 4,499,930

[45] Date of Patent: Feb. 19, 1985

[54] METHOD FOR STORING GAS SAMPLES

[75] Inventor: John P. Walters, Bartlesville, Okla.

[73] Assignee: Phillips Petroleum Company, Bartlesville, Okla.

[21] Appl. No.: 470,800

[22] Filed: Feb. 28, 1983

Related U.S. Application Data

[62] Division of Ser. No. 286,311, Jul. 24, 1981, Pat. No. 4,402,911.

[51] Int. Cl.[3] ..... B67C 5/00

[52] U.S. Cl. ..... 141/8; 73/864.52

[58] Field of Search ..... 141/4, 329, 8; 220/288; 422/102; 73/864.51, 864.52, 864.63, 864.64

[56] References Cited

U.S. PATENT DOCUMENTS

| | | | |
|---|---|---|---|
| 1,022,301 | 4/1912 | Campbell | 222/5 |
| 1,420,721 | 6/1922 | McNiff | 220/3 |
| 1,750,859 | 3/1930 | Raus | 220/3 |
| 2,220,146 | 11/1940 | Curry | 426/477 |
| 2,733,060 | 1/1956 | Taylor | 267/64.13 |
| 2,770,260 | 11/1956 | Henderson | 138/89 |
| 3,635,370 | 1/1972 | Romanauskas | 220/227 |

OTHER PUBLICATIONS

Swagelok Brochure, C-578, pp. 19, 21, Crawford Fitting Co., 29500 Solon Rd., Solon, OH 44139.

"Western Systems Soil Gas Container", 1981.

"USGS Soil Gas Container", 1981.

Whitey Co. Brochure, NW-972, p. 11, Whitey Co., 318 Bishop Rd., Highland Heights, OH 44143.

*Primary Examiner*—Stephen Marcus

*Assistant Examiner*—Mark Thronson

[57] ABSTRACT

A vial closed at one end by a septum is redundantly sealed by a shaped plug for the storage of soil gas samples.

2 Claims, 3 Drawing Figures

METHOD FOR STORING GAS SAMPLES

CROSS REFERENCES TO RELATED APPLICATIONS

The present application is a Divisional Application of application Ser. No. 286,311, now U.S. Pat. No. 4,402,911, entitled, APPARATUS AND METHOD FOR STORING GAS SAMPLES, filed July 24, 1981 by the present inventor.

BACKGROUND OF THE INVENTION

The present invention relates to an apparatus and method for storing gas samples. In another aspect, the present invention relates to an apparatus and method for storing samples of soil gas.

Anomalies in the concentration of the various components of soil gas may be indicative of nearby hydrocarbon deposits, geothermal reservoirs, or deposits of radioactive ores. Prospecting for such energy deposits can be carried out rapidly with soil gas surveys which collect subsurface gaseous emanations generally at a depth from about 18 inches to about 36 inches below ground surface.

Anomalies in the helium concentration in the soil gas sample are frequently indicative of the presence of a nearby deposit. Unfortunately, a helium anomaly may only be about 50 to 100 parts per billion (ppb), which is only about 1% above background helium levels of about 5,238 ppb. Helium anomalies are thus difficult to detect.

One of the greatest difficulties in detecting anomalies of rare gases such as helium is in providing samples for analysis which contain the rare gas at a concentration representative of its concentration in the soil gas below ground level. Helium especially permeates most common materials of construction, and the survey site is frequently a great distance from analysis instruments of the required sensitivity. A helium container which can be used to reliably transport the soil gas sample from the field to the laboratory would be extremely desirable.

OBJECTS OF THE INVENTION

It is an object of this invention to provide an apparatus in which a sample of soil gas can be conveniently and reliably stored.

It is another object of this invention to provide a method for storing soil gas samples for extended time periods in which the characteristics of the stored soil gas sample reliably duplicate the sample as collected.

SUMMARY OF THE INVENTION

According to the invention, a device is provided comprising a tubular member having a closed end, an open end, an interior surface and an exterior surface, the interior surface having a generally annular shoulder facing the open end and positioned near the open end and also a generally frustoconical surface diverging toward the open end positioned between the shoulder and the open end, the exterior surface of the tubular member being provided with threads adjacent to the open end; a resiliently pierceable septum forming a partition across the interior surface of the tubular member; a drawdown nut having a flange partially across its interior surface forming a generally circular opening threadably connected to the open end of the tubular member, a plug having a generally circular cross section, a first end, a second end, and an exterior surface which defines a flange and a frustoconical surface which tapers toward the first end of the plug and is positioned against the frustoconical surface of the tubular member to seal the inside of the tubular member from the outside, the flange facing the second end of the plug and positioned against the flange of the drawdown nut.

The device is used by first evacuating its interior volume. It can then be reliably sealed by the plug and drawdown nut for extended periods of time and transported to the survey site. When a gas sample is desired, the plug and cap are removed from the vial, and the vial is charged with soil gas sample to greater than ambient pressure. The drawdown nut and plug are replaced and tightened to insure that the contents of the vial remain segregated from the environment.

The apparatus provides a more reliable seal than devices known to the art, is reusable, relatively inexpensive, and does not require special tools for use.

DETAILED DESCRIPTION OF THE INVENTION

Figure 1:
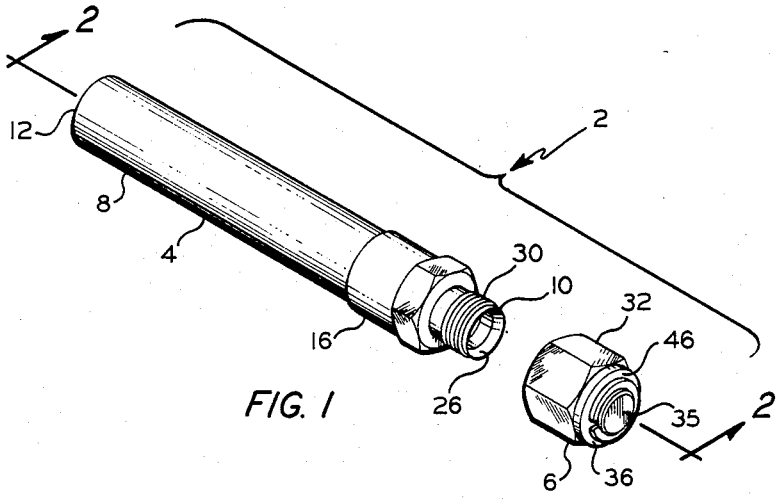
FIG. 1 is a pictorial representation showing certain features of the present invention.
Figure 2:
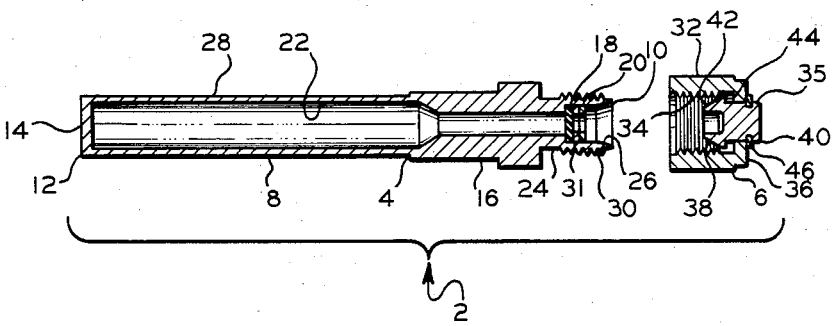
FIG. 2 is a cross-sectional view of a device as taken along the indicated lines shown in FIG. 1.
Figure 3:
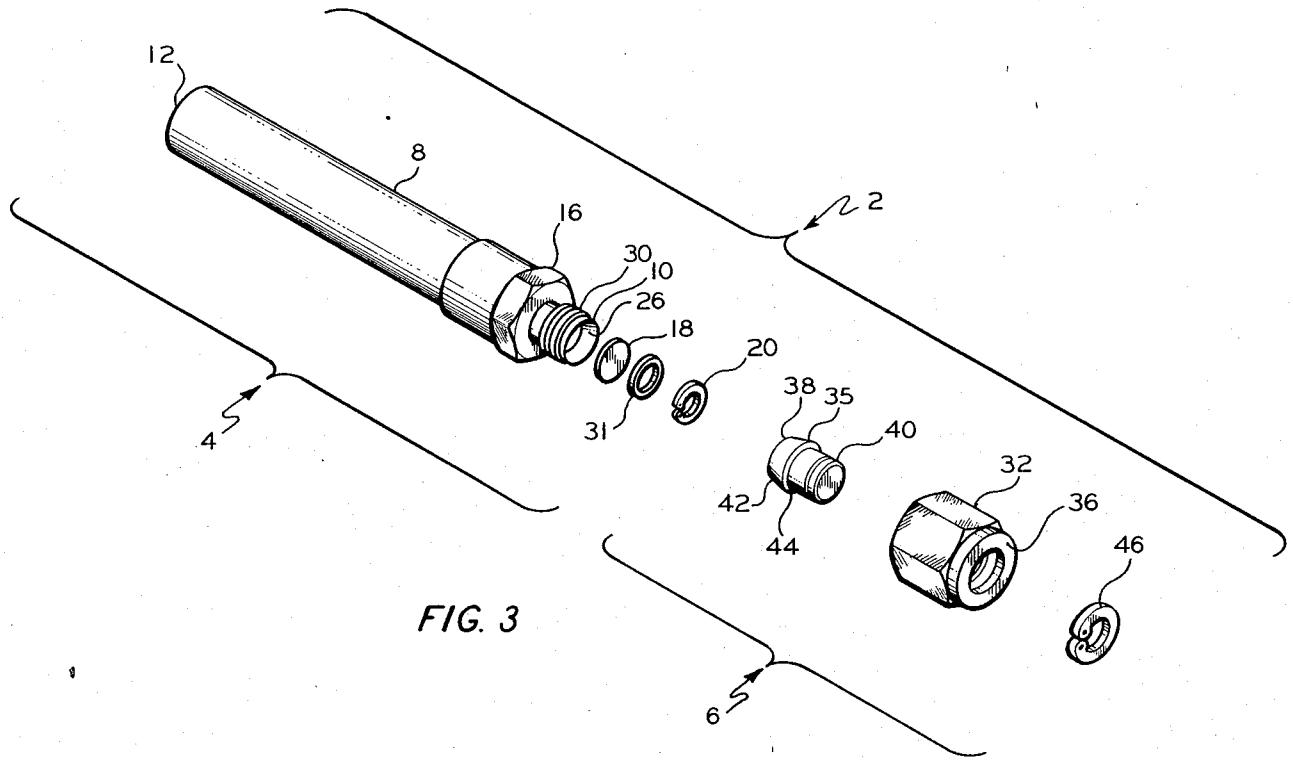
FIG. 3 is an exploded isometric view of the device shown in FIG. 2.

According to the invention, a container 2 comprises a vial 4 and a removable end closure 6.

The vial 4 is preferably formed from a tubular member 8 open at its first end 10 and closed at its second end 12 via suitable closure such as a disc 14. Generally, the tubular member has a longitudinal axis and a generally annular cross section in a plane normal to its longitudinal axis. A suitable tubular member was formed of 304 stainless steel seamless tubing having a $\frac{5}{8}$ inch outside diameter and a wall thickness of 0.035 inches. The closure for end 12 was formed from a compatible stainless steel disc which was welded to the tube. A Swagelok®16, a registered trademark available from Tulsa Valve & Fitting Company, Tulsa, Okla., and having a septum 18 preferably positioned by a snap ring 20 forms the open first end of the tubular member. The interior surface 22 of the tubular member 8 is provided with a generally annular shoulder 24 facing the open first end 10 which is positioned near the open first end 10. Preferably, the shoulder defines a relatively narrow neck which opens into the main body of the vial, the inside diameter neck having a diameter of less than the septum of preferably 25 mm or less, such as 8 mm, so that the unsupported portion of the septum is relatively small. A generally frustoconical surface portion 26 of the interior surface 22 of the tubular member diverges towards the open first end of the tubular member 8 and is positioned between the annular shoulder 24 and the open first end of the tubular member. An exterior surface 28 of the tubular member 8 is provided with threads 30 adjacent to open first end 10.

The septum 18 is resiliently pierceable and is positioned against the annular shoulder 24 of the tubular member 8. It forms a partition across the interior surface of the tubular member 8. A preferred septum having a diameter of 10 mm and a thickness of 3.5 mm and a disc shape is formed from silicone rubber. Such a septum can be used dozens of times with a small diameter piercing device without replacement. If desired, an annular washer 31 can be positioned between the septum 18 and the lock ring 20 to strengthen the septum and reduce helium leakage. Further, the septum can be metallized or laminated with aluminum foil, for example to reduce helium leakage. Generally, the septum can be pierced 50 or more times before it must be replaced.

The retainer ring 20 is preferably of the interior snap-ring type. It has been found to be unnecessary to seat the snap ring 20 in a groove in order to retain the septum against the shoulder 24, due to the relatively mild pressures inside the vial when it is in use, which typically will not exceed about 50 pounds per square inch gauge (psig). A ⅜" spring steel lock ring pressed against the interior surface 22 of the tubular member 8 and urging against a generally annular portion of the septum 18 or washer 31 when employed has been used with good results. The snap-ring preferably urges against a generally cylindrical portion of interior surface 22 which extends from shoulder 24 to frustocone 26. Typically, the vial 4 has an interior volume defined between the septum 18 and the disc 14 by the interior surface 22 of the tubular member in the range of about 1/10 to about 100 cubic centimeters (c.c.) usually between about 5 and 20 c.c. A vial having an interior volume of about 10 c.c. is preferred because such has been used with good results.

The removable end closure 6 comprises a drawdown nut 32 having threads 34 on its interior surface for engaging the threads 30 on the exterior surface of the tubular member 8, and a plug 35 carried by the drawdown nut 32. The nut 32 is provided with a flange 36 extending at least partially across its interior surface and defining a generally circular opening. Flange 36 preferably has a generally annular shape. The plug 35 has a generally circular cross section, a first end 38, a second end 40 and exterior surface extending therebetween, a portion of which defines a frustoconical surface 42 which tapers towards the first end 38 of the plug 35. In use, the frustoconical surface 42 is positioned against the frustoconical surface 26 of the tubular member 8 and seals the inside of the tubular member from the outside. The plug 35 is further provided with a flange surface 44 preferably having a generally annular shape which faces the second end 40 of the plug 35 and is positioned against the flange 36 of the drawdown nut 32 when the vial is sealed.

The drawdown nut can be formed from most any suitable material such as brass or stainless steel. The plug likewise can be formed from a durable metal. However, it is preferred that the plug be formed from a resilient material, such as nylon, which is a polyamide, because plugs formed from nylon can be used to seal the inventive device redundantly against helium permeation merely by finger-tightening the draw-down nut 32 and also have proved more durable than plugs formed from harder material such as steel. Nylon is the material of choice because it has been used with good results.

For convenience, it is preferred that the plug 35 be provided with a generally cylindrical portion which extends from the flange 44 of the plug through the circular opening defined by the flange 36 of the drawdown nut 32. When this design is utilized, the plug and draw-down nut can be retained as an assembly by positioning a ring 46 such as an exterior snap ring on the cylindrical portion of the plug which extends through the circular opening in the drawdown nut. Preferably, the cylindrical portion of the plug is provided with a groove around its girth for mounting of the snap ring.

The apparatus is utilized by first evacuating the vial to a pressure of less than about 10 torr, preferably between about 0.01 and about 1 torr, such as about 0.1 torr. The vial is easily evacuated by inserting a syringe needle through the rubber septum and into the vial and connecting the syringe needle to a vacuum pump, drawing a vacuum in the vial, and then removing the syringe needle while still drawing the vacuum. By utilizing the cap and plug, the evacuated device can be provided at most any location while retaining a pressure of less than about 10 torr in its interior volume. At the survey site, a sufficient amount of soil gas sample is injected with a syringe needle through the septum and into the vial to provide a positive pressure of between about 800 and about 4,000 torrs of soil gas. For example, where the vial has an interior volume of about 10 cubic centimeters, a syringe having an interior volume of between about 20 and 50 cubic centimeters could be employed with good results for injection of soil gas into the vial. Once the sample has been injected, the closure is positioned on the device to redundantly seal the interior from the environment. The plug 35 is positioned with its frustoconical surface contacting the frustoconical surface of the tubular member and its annular flange contacting the annular flange of the drawdown nut. The drawdown nut is threaded onto the tubular member and tightened to provide a reliable gas seal between the frustoconical surfaces. For example, where the plug 35 is formed from nylon, it will reliably seal the interior of the apparatus from the exterior when the nut 32 is finger tightened. To facilitate such tightening, the exterior surface of the drawdown nut can be knurled or provided with wrench flats or the like. In the illustrated embodiment, the exterior surfaces of both the vial and the closure are provided with hexagonal wrench flats.

While certain preferred embodiments of the invention have been described for the sake of illustration, the invention is not to be construed as so limited except to the extent that such limitations are found in the claims.

What is claimed is:

1. A method for storing a soil gas sample comprising:

(a) providing an apparatus comprising a tubular member having a closed end, an open end, an interior surface and an exterior surface, the interior surface having a generally annular shoulder facing the open end and positioned near the open end and a generally frustoconical surface diverging toward the open end positioned between the shoulder and the end, the exterior surface of the tubular member being provided with threads adjacent its open end; and a resiliently pierceable septum positioned against the annular shoulder and forming a partition across the interior surface of the tubular member, an interior volume being defined by the septum and tubular member which is in the range of from about 1/10 to about 100 cubic centimeters, said interior volume being evacuated to a pressure of less than about 10 torr;

(b) injecting a sufficient amount of soil gas sample into the interior volume of the apparatus to provide a pressure of from about 800 to about 4000 torr of soil gas;

(c) positioning a plug having a frustoconical surface with its frustoconical surface against the frustoconical surface of the tubular member, the plug further having an annular flange facing oppositely from the frustoconical surface;

(d) connecting a drawdown nut to the open end of the tubular member, said drawdown nut having a threaded interior surface and a flange extending at least partially across its interior surface connecting the flange of the plug; and (e) after said injecting, tightening the drawdown nut to contact the annular flange of the plug with the annular flange of the drawdown nut to urge the frustoconical surface of the plug against the frustoconical surface of the tubular member to seal the inside of the tubular member from the outside.

2. A method as in claim 1 wherein the apparatus has an interior volume of between about 5 and about 20 cubic centimeters and has been evacuated to a pressure of between about 0.01 and about 1 torr, wherein the septum is formed from silicon rubber and the plug is formed from nylon and the gas sample stored in the apparatus contains a helium anomaly.

* * * * *